US008813434B2

(12) United States Patent
Koppelman et al.

(10) Patent No.: US 8,813,434 B2
(45) Date of Patent: Aug. 26, 2014

(54) RETAIL KIOSK

(71) Applicant: Target Brands, Inc., Minneapolis, MN (US)

(72) Inventors: Kristin M. Koppelman, Roseville, MN (US); Melissa M. Champine, Burnsville, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 13/626,033

(22) Filed: Sep. 25, 2012

(65) Prior Publication Data

US 2014/0083024 A1 Mar. 27, 2014

(51) Int. Cl.

| | |
|---|---|
| ***A47F 3/00*** | (2006.01) |
| ***A47F 10/00*** | (2006.01) |
| ***E04H 1/00*** | (2006.01) |
| ***E04H 12/00*** | (2006.01) |
| ***E04H 12/28*** | (2006.01) |
| ***E04B 5/48*** | (2006.01) |

(52) U.S. Cl.
USPC ..... 52/79.5; 52/36.1; 52/79.7; 52/79.8; 52/110; 52/244; 52/503; 902/30; 902/31; 902/32; 902/34; 902/35; 312/138.1

(58) Field of Classification Search
USPC ..... 52/36.1, 36.6, 79.5, 79.7, 79.8, 110, 52/236.2, 244, 503, 504, 505; 902/30–35; 244/159.4, 159.5, 120; 312/283, 287, 312/138.1
See application file for complete search history.

(56) References Cited

U.S. PATENT DOCUMENTS

| | | | | |
|---|---|---|---|---|
| 1,003,116 | A * | 9/1911 | Madsen | 109/19 |
| 1,313,364 | A * | 8/1919 | Williams | 312/274 |
| D68,981 | S | 12/1925 | McInroy | |
| D69,762 | S | 3/1926 | Kurowski | |
| 2,563,886 | A | 8/1951 | Taylor | |
| 2,792,164 | A * | 5/1957 | Cauffiel | 182/194 |
| 2,907,601 | A * | 10/1959 | Kuchenbecker et al. | 296/168 |
| 3,009,672 | A * | 11/1961 | Tharratt | 244/137.1 |
| 3,446,545 | A * | 5/1969 | Horlacher | 312/311 |
| 3,653,615 | A * | 4/1972 | Spence | 244/137.1 |
| 3,799,604 | A | 3/1974 | Letourneux | |
| D245,866 | S | 9/1977 | Schuldenfrei et al. | |
| 4,073,101 | A | 2/1978 | Yoshida | |
| D251,613 | S | 4/1979 | Wollman | |

(Continued)

FOREIGN PATENT DOCUMENTS

FR 2857683 A1 1/2005

OTHER PUBLICATIONS

Pending U.S. Appl. No. 29/433,025, filed Sep. 25, 2012, entitled Retail Kiosk, 13 pages.

(Continued)

*Primary Examiner* — Phi A
*Assistant Examiner* — Omar Hijaz
(74) *Attorney, Agent, or Firm* — Nixon & Vanderhye P.C.

(57) ABSTRACT

A retail kiosk includes a product fulfillment portion and a product display portion. The product fulfillment portion includes a cylindrical shell having an end with a continuous, circular edge. The product display portion includes a cylindrical shell having an end with a continuous, circular edge. The continuous, circular edge of the product fulfillment portion is out of alignment with the continuous, circular edge of the product display portion when the retail kiosk is deployed.

9 Claims, 12 Drawing Sheets

(56) References Cited

U.S. PATENT DOCUMENTS

| | | | | |
|---|---|---|---|---|
| 4,174,594 | A | 11/1979 | Panzini | |
| D255,719 | S | 7/1980 | Panzini | |
| D257,490 | S | 11/1980 | Davis | |
| 4,453,327 | A | 6/1984 | Clarke | |
| 4,471,586 | A | 9/1984 | Shuch et al. | |
| 4,601,509 | A * | 7/1986 | Ellis, Sr. | 296/22 |
| D285,913 | S | 9/1986 | Chambers | |
| D286,432 | S * | 10/1986 | Markham | D25/19 |
| 4,653,238 | A | 3/1987 | Berman | |
| 4,704,827 | A | 11/1987 | Murphy et al. | |
| D296,131 | S | 6/1988 | James | |
| 4,794,717 | A | 1/1989 | Horsmann | |
| 4,805,356 | A | 2/1989 | Feisst | |
| D309,124 | S * | 7/1990 | Young | D12/102 |
| D311,956 | S | 11/1990 | Barnes | |
| 5,086,999 | A * | 2/1992 | Mullen | 244/159.4 |
| 5,271,669 | A | 12/1993 | Pearlson | |
| D345,217 | S * | 3/1994 | Pearlson | D25/16 |
| 5,647,074 | A | 7/1997 | White, Jr. et al. | |
| 5,702,166 | A | 12/1997 | Lee | |
| D403,078 | S | 12/1998 | Allan et al. | |
| 6,164,462 | A * | 12/2000 | Mumford | 211/59.2 |
| 6,216,984 | B1 * | 4/2001 | Brinsmade | 244/171.9 |
| D447,311 | S | 8/2001 | Swaine | |
| 6,321,746 | B1 * | 11/2001 | Schneider et al. | 128/202.12 |
| 6,439,345 | B1 | 8/2002 | Recktenwald et al. | |
| D467,753 | S | 12/2002 | Simpson | |
| 6,499,697 | B1 * | 12/2002 | Patel et al. | 244/172.4 |
| 6,688,673 | B2 * | 2/2004 | Kloepfer | 296/181.1 |
| D519,645 | S | 4/2006 | Wright et al. | |
| 7,185,809 | B2 | 3/2007 | Barton et al. | |
| D545,451 | S | 6/2007 | Urbanek | |
| D550,855 | S | 9/2007 | Tonella | |
| D555,524 | S | 11/2007 | Jacobsen et al. | |
| D569,009 | S | 5/2008 | Hallberg | |
| 7,445,600 | B1 | 11/2008 | Carr et al. | |
| D583,963 | S | 12/2008 | Perez Lazala | |
| 7,588,107 | B2 * | 9/2009 | Nicholes | 180/14.2 |
| 7,681,837 | B2 * | 3/2010 | Nakamura et al. | 244/129.4 |
| 7,699,267 | B2 * | 4/2010 | Helou, Jr. | 244/137.1 |
| 7,715,175 | B2 | 5/2010 | De La Fuente | |
| D621,524 | S | 8/2010 | Olson et al. | |
| D633,010 | S | 2/2011 | Hixson et al. | |
| 7,942,461 | B2 | 5/2011 | Cohen et al. | |
| 7,950,538 | B2 * | 5/2011 | Zang et al. | 211/187 |
| D639,449 | S * | 6/2011 | Luburic | D25/1 |
| 8,032,420 | B2 | 10/2011 | Dziaba et al. | |
| D653,589 | S | 2/2012 | Hixson et al. | |
| D653,995 | S * | 2/2012 | Hixson et al. | D12/102 |
| D656,240 | S | 3/2012 | Andreini et al. | |
| D668,582 | S | 10/2012 | Doron | |
| 2005/0000924 | A1 * | 1/2005 | Webb | 211/59.2 |
| 2006/0043846 | A1 * | 3/2006 | Kamp et al. | 312/114 |
| 2008/0313046 | A1 | 12/2008 | Denenburg et al. | |
| 2009/0308693 | A1 | 12/2009 | Johnson, Jr. | |
| 2010/0023372 | A1 | 1/2010 | Gonzalez | |
| 2011/0067321 | A1 * | 3/2011 | Hijazi | 52/79.1 |
| 2011/0214362 | A1 * | 9/2011 | Huang | 52/79.5 |

OTHER PUBLICATIONS

Office Action from Canadian Patent Application No. 2,792,526, mailed Jan. 30, 2013 (3 pages).

Office Action from Canadian Patent Application No. 2,792,526, mailed Jun. 7, 2013 (2 pages).

Office Action from Canadian Patent Application No. 2,792,526, mailed Dec. 4, 2013 (2 pages).

* cited by examiner

RETAIL KIOSK

BACKGROUND

Kiosks are small, freestanding structures that display goods and/or services for sale. For example, a kiosk can house goods that are on display, which can then be selected by a customer and purchased at a counter located in the kiosk.

The discussion above is merely provided for general background information and is not intended to be used as an aid in determining the scope of the claimed subject matter.

SUMMARY

A retail kiosk includes a product fulfillment portion and a product display portion. The product fulfillment portion includes a cylindrical shell having an end with a continuous, circular edge. The product display portion includes a cylindrical shell having an end with a continuous, circular edge. The continuous, circular edge of the product fulfillment portion is oriented out of alignment with the continuous, circular edge of the product display portion when the retail kiosk is deployed.

The product fulfillment portion includes an interior space having a distribution section and a stock section. The distribution section extends a portion of a length of the cylindrical shell and the stock section is separated from the distribution section by a partition and extends a remaining portion of the length of the cylindrical shell. A passageway in the partition includes a support shelf for holding product that is passed between the stock section and the distribution section.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

The disclosure describes a mobile retail kiosk or pod that is transported to a site in a shipping configuration and then converted at the site into a deployed configuration. The retail kiosk includes at least one cylindrical or tube-like structure that is capable of displaying products for sale or for giveaway and for hosting all of the necessary steps in processing a sales order or distributing giveaway items including stocking the items.

Figure 1:
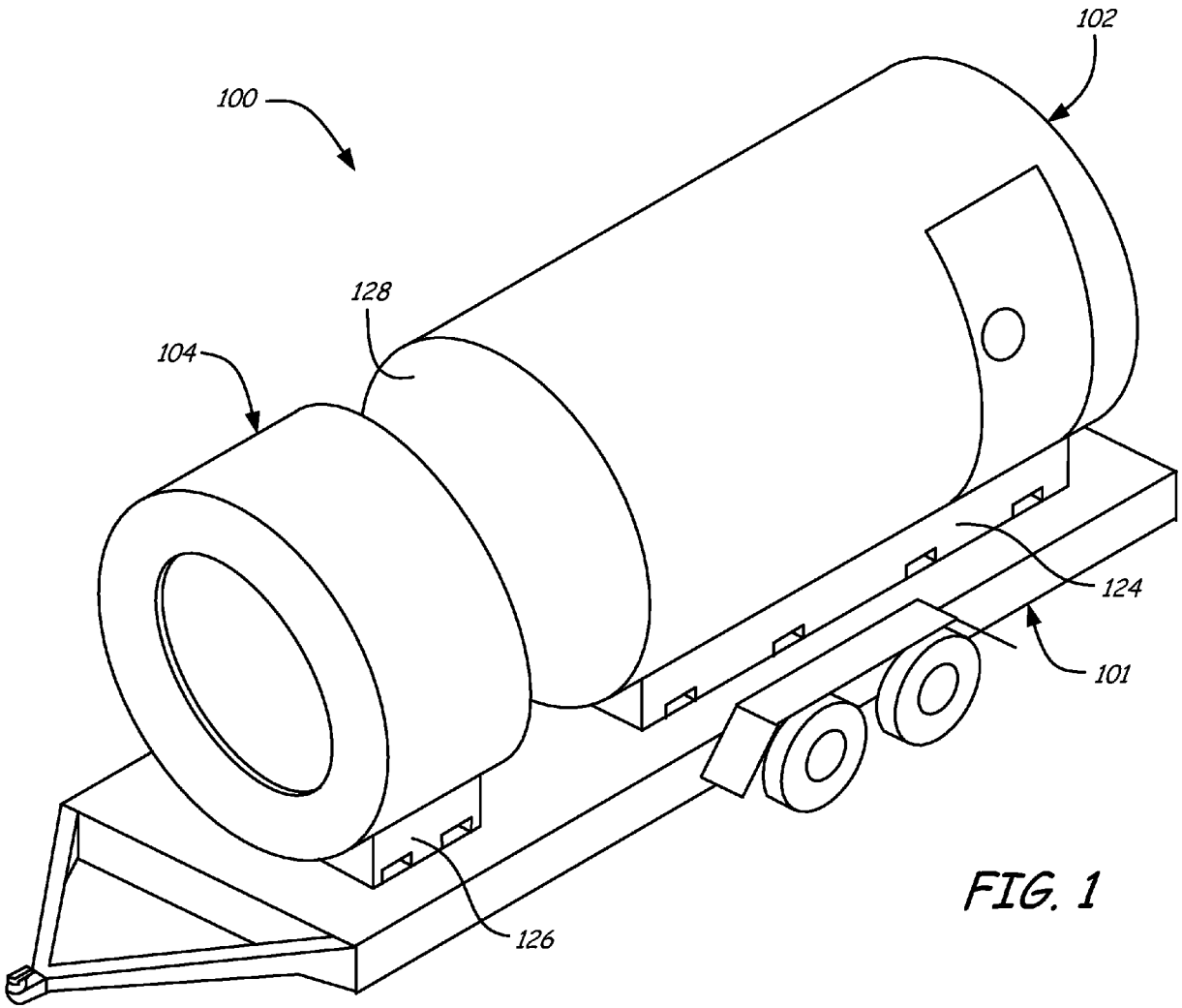
FIG. 1 is a perspective view of a retail kiosk in a shipping configuration according to one embodiment.
Figure 2:
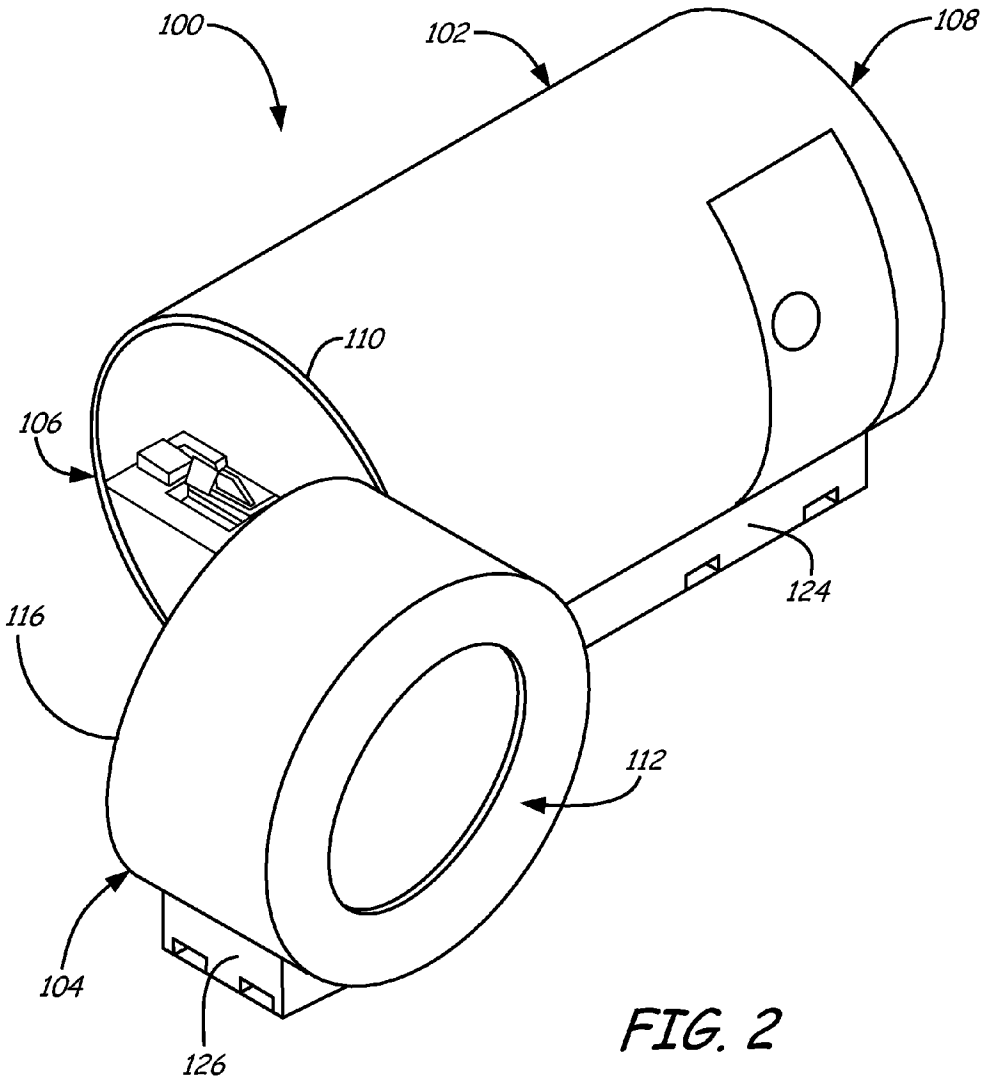
FIG. 2 is a perspective view of the retail kiosk illustrated in FIG. 1 in a deployed configuration.

FIG. 1 is a perspective view of a retail kiosk or retail pod 100 in a shipping configuration according to one embodiment. In FIG. 1, retail kiosk 100 is positioned on a flatbed of a trailer 101 for shipping. In other words, retail kiosk 100 is configured for transporting stock items or stock product from one location to another via trailer 101. It should be realized that trailer 101 is one mode for transporting retail kiosk 100 in a shipping configuration. In other embodiments, retail kiosk 100 could include its own integral trailer hardware, such as a set of wheels and a hitch, for connecting to a truck for transport. FIG. 2 is a perspective view of retail kiosk 100 in a deployed configuration according to one embodiment. In other words, in FIG. 2, retail kiosk 100 has been removed from trailer 100 and is configured to allow customers or guests to select product to purchase or to take, and provide the necessary space and equipment to process, distribute and/or fulfill orders.

As illustrated in FIGS. 1 and 2, retail kiosk 100 includes a first cylindrical shell or tube-like structure that is a product fulfillment portion 102 and a second cylindrical shell or tube-like structure that is a product display portion 104. Product fulfillment portion 102 houses all the necessary equipment for processing, distributing and/or fulfilling transactions, while product display portion 104 houses all the necessary equipment for displaying product for purchase or for giveaway.

In the shipping configuration illustrated in FIG. 1, product fulfillment portion 102 is spaced apart from product display portion 104. However, in other embodiments, product fulfillment portion 102 and product display portion 104 could be coupled, connected, engaged, interlocked or otherwise put together to form a single unit or look to be as if formed as a single unit. In the deployed configuration illustrated in FIG. 2, product fulfillment portion 102 and product display portion 104 are in contact. However, in other embodiments, product fulfillment portion 102 and product display portion 103 can be spaced apart.

Figure 3:
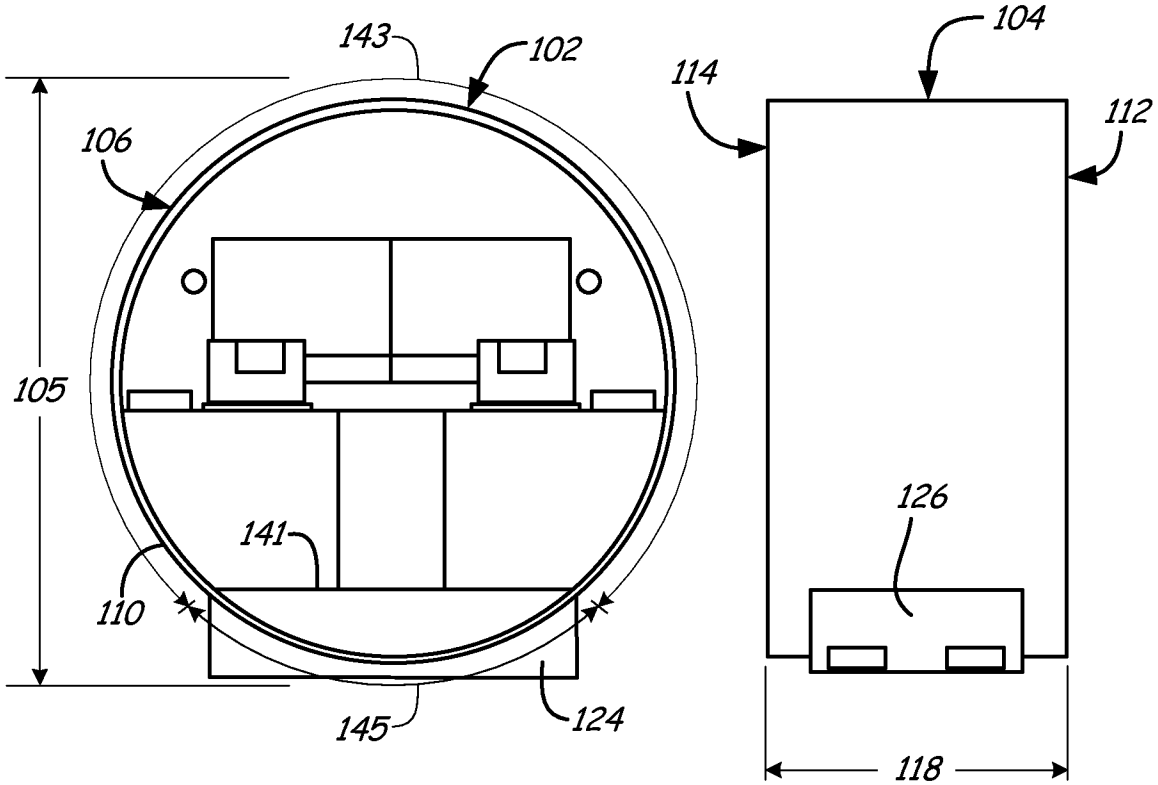
FIG. 3 is a front view of the retail kiosk illustrated in the FIG. 2 deployed configuration.
Figure 4:
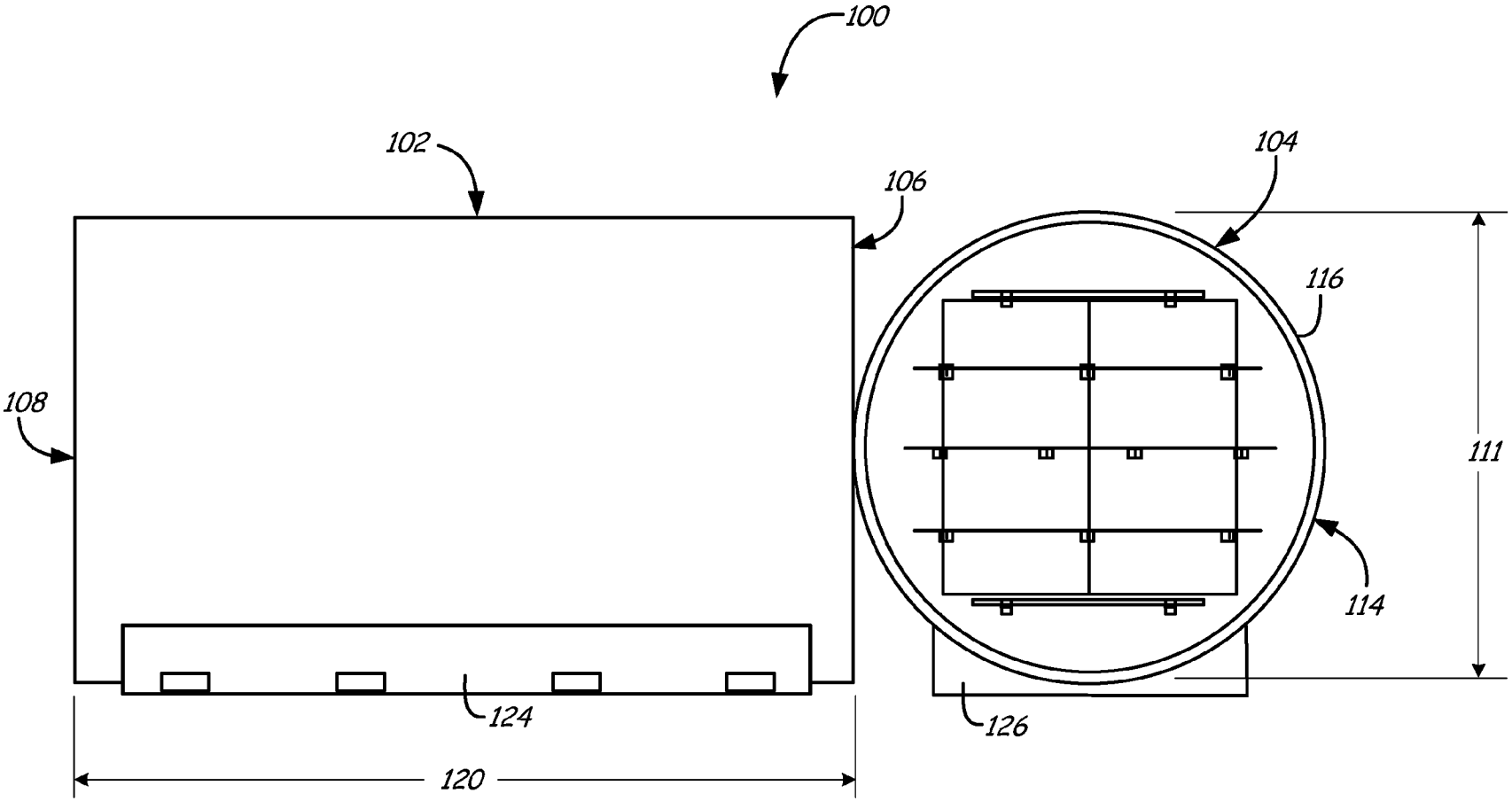
FIG. 4 is a side view of the retail kiosk illustrated in the FIG. 2 deployed configuration.

FIG. 3 is a front view of retail kiosk 100 illustrated in the FIG. 2 deployed configuration and FIG. 4 is a side view of retail kiosk 100 illustrated in the FIG. 2 deployed configuration. As illustrated in FIGS. 2-4, product fulfillment portion or first cylindrical shell 102 includes an outer diameter 105, a front end 106 and a back end 108. Front end 106 is an open end having a continuous, circular edge 110 and back end 108 is a closed end. Product display portion or second cylindrical shell 104 includes an outer diameter 111, a front end 112 and a back end 114. Front end 112 is a closed end and back end 114 is an open end having a continuous, circular edge 116.

Figure 5:
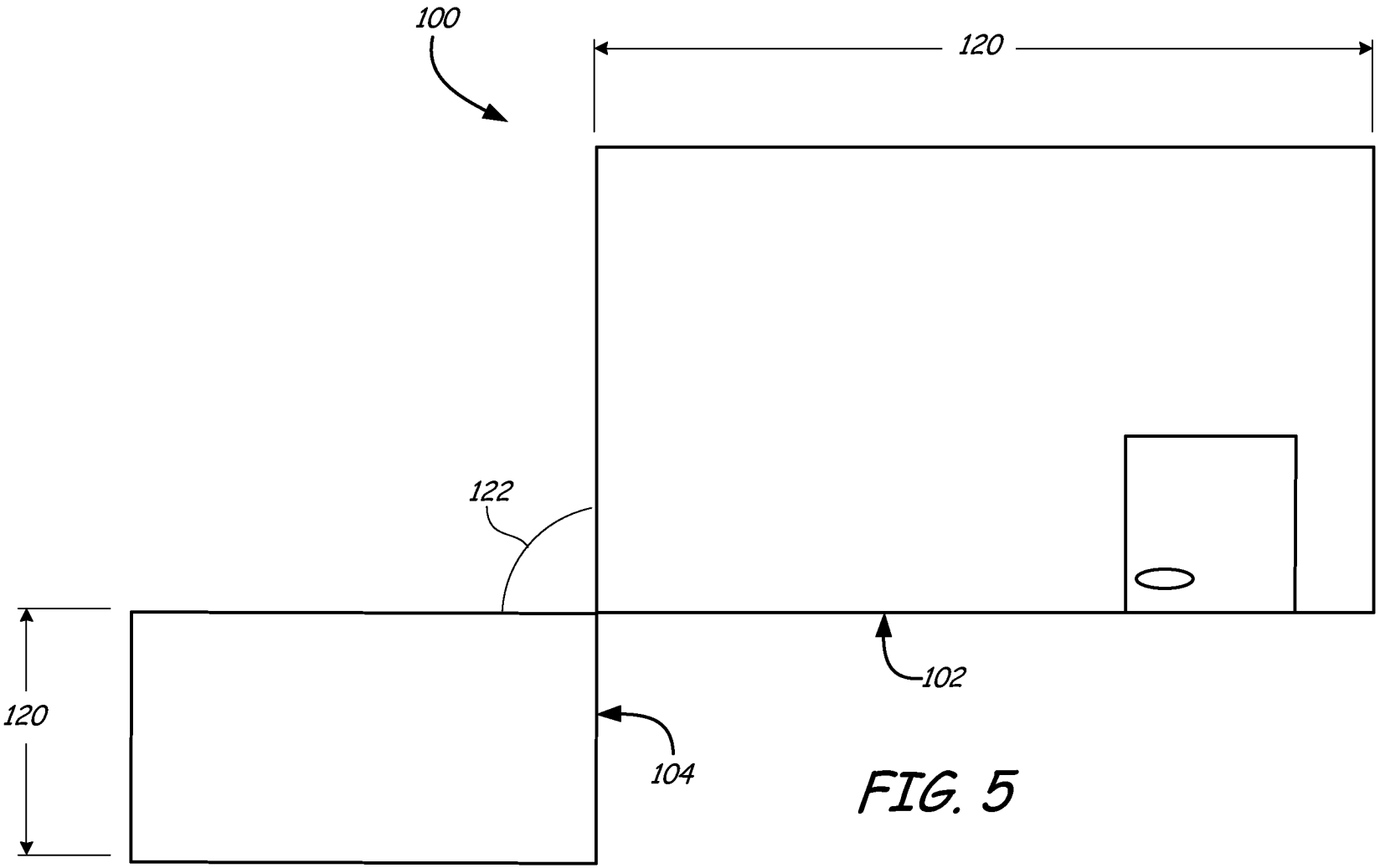
FIG. 5 is a top view of the retail kiosk illustrated in the FIG. 2 deployed configuration.

As illustrated in the shipping configuration in FIG. 1, continuous, circular edge 116 or outer diameter 111 of product display portion 104 is in alignment with continuous, circular edge 110 or outer diameter 105 of product fulfillment portion 102. However, and as illustrated in the deployed configuration in FIGS. 2-4, continuous, circular edge 116 or outer diameter 111 of product display portion 104 is out of alignment from continuous, circular edge 110 or outer diameter 105 of product fulfillment portion 102. In other words, a length 118 of product display portion 104 is oriented at an angle 122 (as evidenced in the FIG. 5 top view of retail kiosk 100 illustrated in the FIG. 2 deployed configuration) relative to a length 120 of product fulfillment portion 102. As illustrated in FIG. 5, angle 122 is a right angle or substantially a 90 degree angle. However, it should be realized that other angles are considered including acute angles, obtuse angles and an angle that is substantially 180 degrees. Still further, it should be pointed out that in the embodiment illustrated in FIGS. 1-5, length 118 of product display portion 104 is less than length 120 of product fulfillment portion 102. However, in other embodiments. Product display portion 104 can be greater than or equal to length 120 of product fulfillment portion 102.

Because product fulfillment portion 102 and product display portion 104 include open ends 106 and 116, respectively, in the shipping configuration illustrated in FIG. 1, circular panels of wood or other type of material can be coupled to open ends 106 and 114 in order to keep the contents in product fulfillment portion 102 and product display portion 104 from falling out. As illustrated in FIG. 1, open end 106 is covered by a panel 128 having a diameter that substantially matches outer diameter 105 of product fulfillment portion 102.

As illustrated in FIGS. 1-4, product fulfillment portion 102 includes a base 124 and product display portion 104 includes a base 126. Base 124 supports the cylindrical shell of product fulfillment portion 102 and base 126 supports the cylindrical shell of product display portion 104. In this way, the cylindrical shell of each portion 102 and 104 can be oriented such that the curved sides of the cylinder are substantially horizontal with respect to the flatbed of trailer 101 when in a shipping configuration or with respect to the ground when in a deployed configuration.

Figure 6:
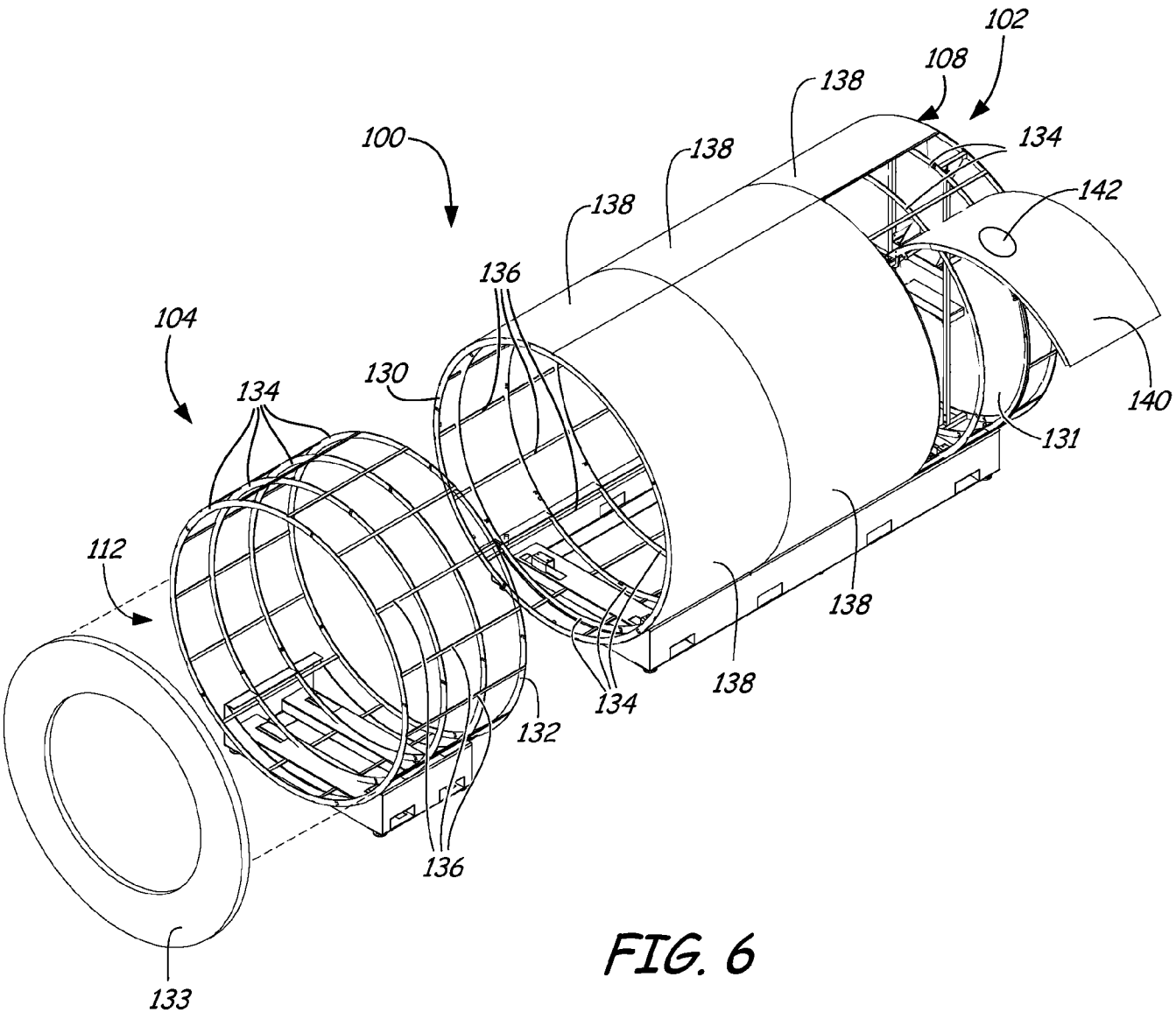
FIG. 6 is one embodiment of an exploded view of the retail kiosk illustrated in FIGS. 1-5 in the shipping configuration.

FIG. 6 is one embodiment of an exploded view of retail kiosk 100 in the shipping configuration with trailer 101 and other components removed for purposes of clarity. As illustrated, product fulfillment portion 102 and product display portion 104 are constructed of a lattice frame 130 and 132 and include respective cap ends 131 and 133 that close off ends 108 and 112. Lattice frames 130 and 132 each include a plurality of circular frame members 134 connected together by a plurality of lateral frame members 136. Attached on the exterior of each lattice frame 120 and 132 are a plurality of curved panels 138. The curved panels of product display portion 104 are removed for clarity, but the curved panels 138 of product fulfillment portion 102 are shown. Curved panels 138 act as the outer skin of each of portions 102 and 104 and provide a surface for each of portions 102 and 104 that define outer diameters 105 and 111.

Product fulfillment portion 104 as shown in FIG. 6 also illustrates a curved door 140 in an open position. Curved door 140 includes a circular portal window 142. Curved door 140 is hinged to lattice frame 130 such that when it is in an open position the bottom edge includes a free end and the top edge is fixed to frame 130. In a closed position, the outer surface of curved door 140 is in alignment with the outer surface of curved panel 138.

Figure 7:
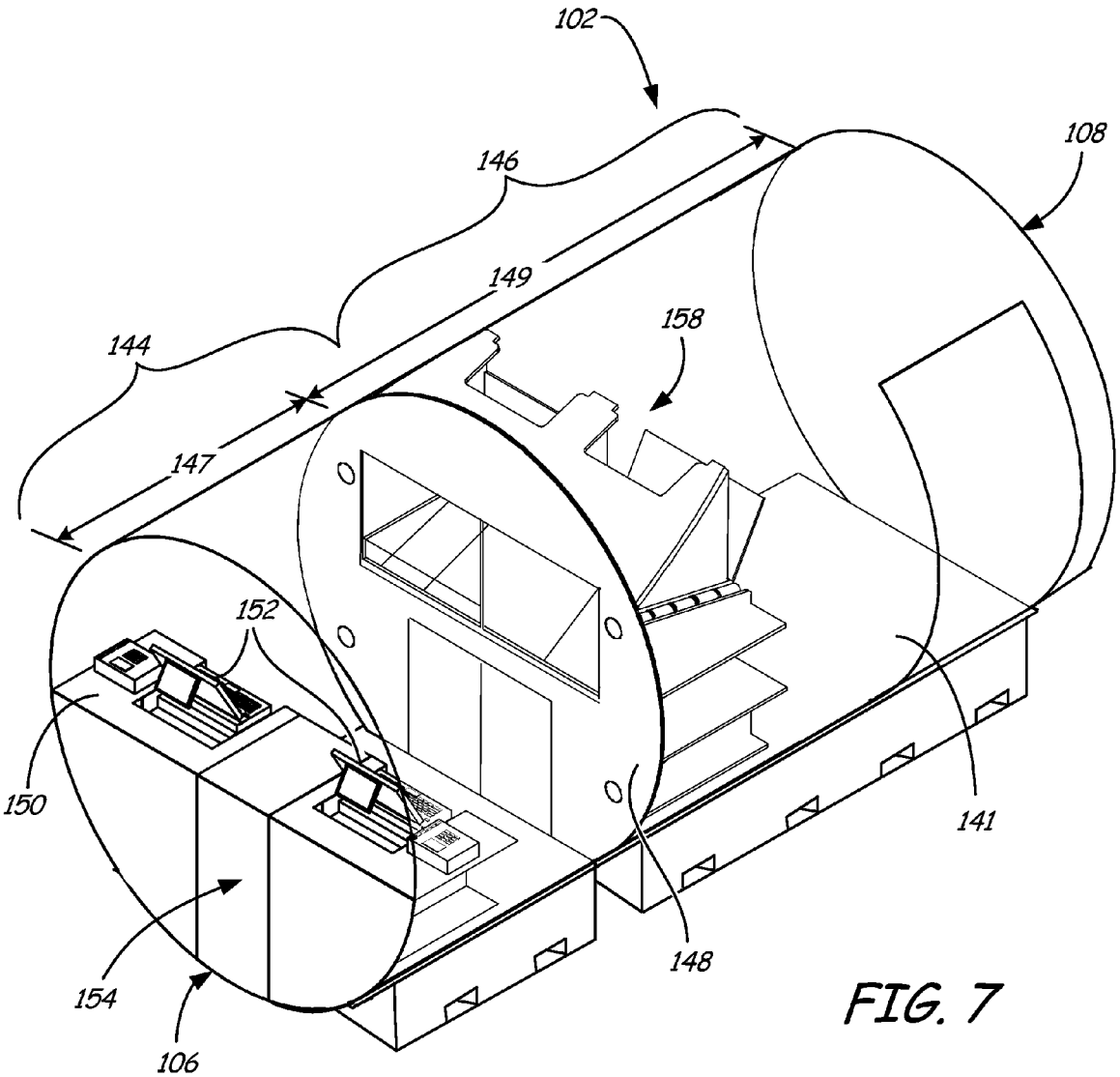
FIG. 7 is a front perspective view of a product fulfillment portion of the retail kiosk illustrated in FIGS. 1-5 showing interior features in lightweight phantom lines.
Figure 8:
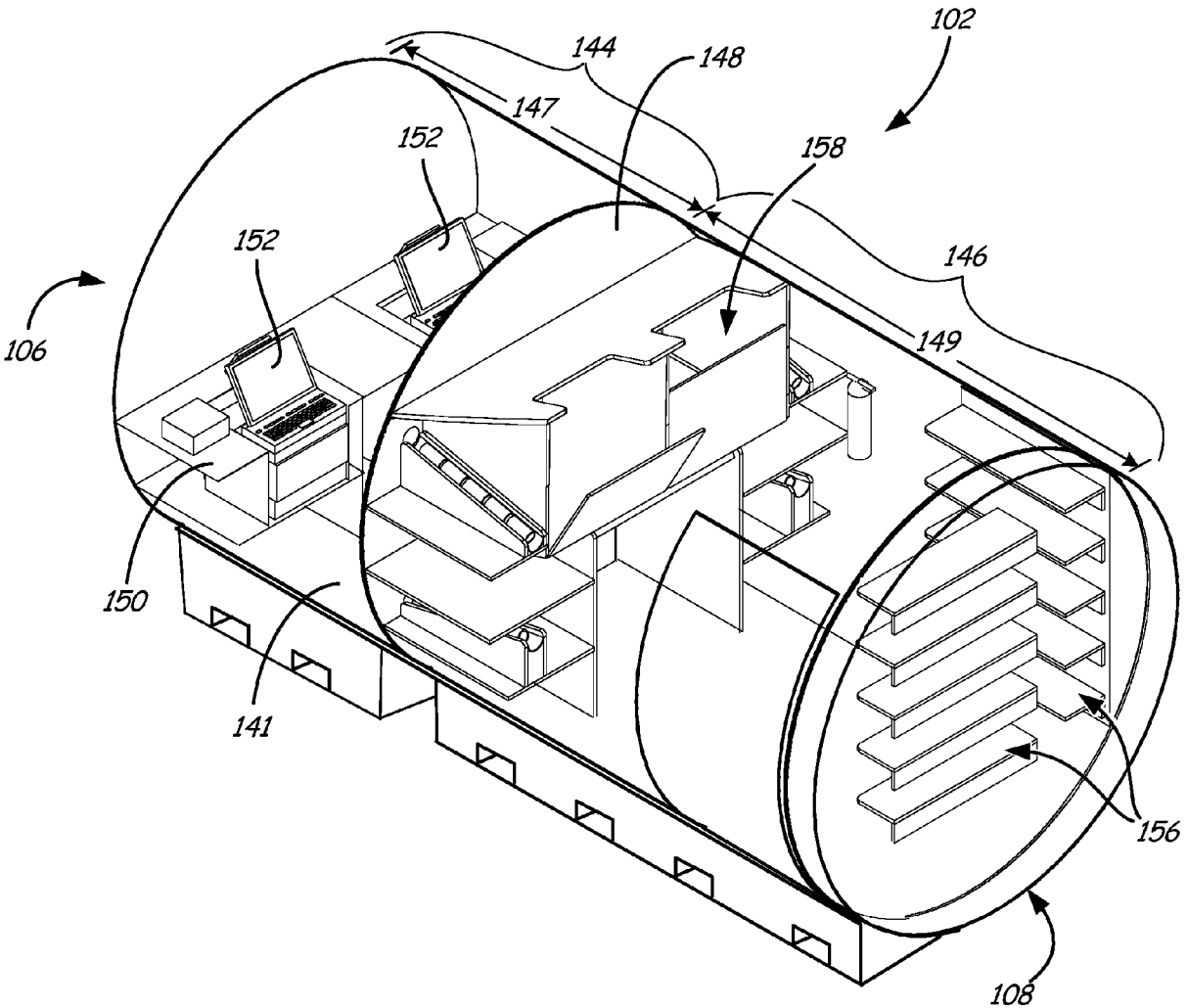
FIG. 8 is a back perspective view of the product fulfillment portion illustrated in FIG. 7 showing the interior features in lightweight phantom lines.

FIG. 7 is a front perspective view of product fulfillment portion 102 of retail kiosk 100 showing interior features in lightweight phantom lines. FIG. 8 is a back perspective view of product fulfillment portion 102 illustrated in FIG. 7 showing the interior features in lightweight phantom lines. As illustrated in FIGS. 7 and 8, product fulfillment portion 102 of retail kiosk 100 includes a floor 141. With reference to FIG. 3, floor 141 divides the cylindrical shell of product fulfillment portion 102 into a major curved wall segment 143 and a minor curved wall segment 145.

In addition, product fulfillment portion 102 has an interior space that includes a register, checkout or distribution section 144 and a stock section or backroom area 146 that is separated from register or distribution section 144 by a partition or divider wall 148. Partition 148 extends substantially perpendicular to floor 141 and intersects with major curved wall segment 143. Register or distribution section 144 is located at the front of product fulfillment portion 102 and is therefore defined between open end 106 of product fulfillment portion 102 and partition 148. Register or distribution section 144 occupies a portion 147 of length 120 of product fulfillment portion 102. Stock section 146 is located at the back of product fulfillment portion 102 and is therefore defined between partition 148 and closed end 108. Stock section 146 occupies a remaining portion 149 of length 120 of product fulfillment portion 102.

Register or distribution section 144 provides the space needed for holding employees, equipment and, in some embodiments, customers or guests who are performing or partaking in transactions or receipt of stock items. The process of completing an order transaction will be discussed in detail below. Stock section 146 provides the space needed for holding employees and stock items that can be purchased or given away. As illustrated in FIGS. 7 and 8, register or distribution section 144 includes a counter 150 including a rotatable leaf, at least one register 152 and a passageway 154. In some embodiments, a table can be set in register or distribution section 144 and registers 152 removed for ease of giving away products. In FIG. 7, the rotatable leaf covers the top of passageway 154. However, leaf can be rotatably removed for employees to get behind counter 150 through passageway 154. Stock section 146 includes at least one shelving unit 156 for storing stock items for purchase.

Product fulfillment portion 102 also includes a product retrieval system 158 for conveying product orders from register section 144 to stock section 146 and, in return, passing product from stock section 146 to register section 144. Product retrieval system 158 includes at least one passageway that is located in partition or divider wall 148.

Figure 9:
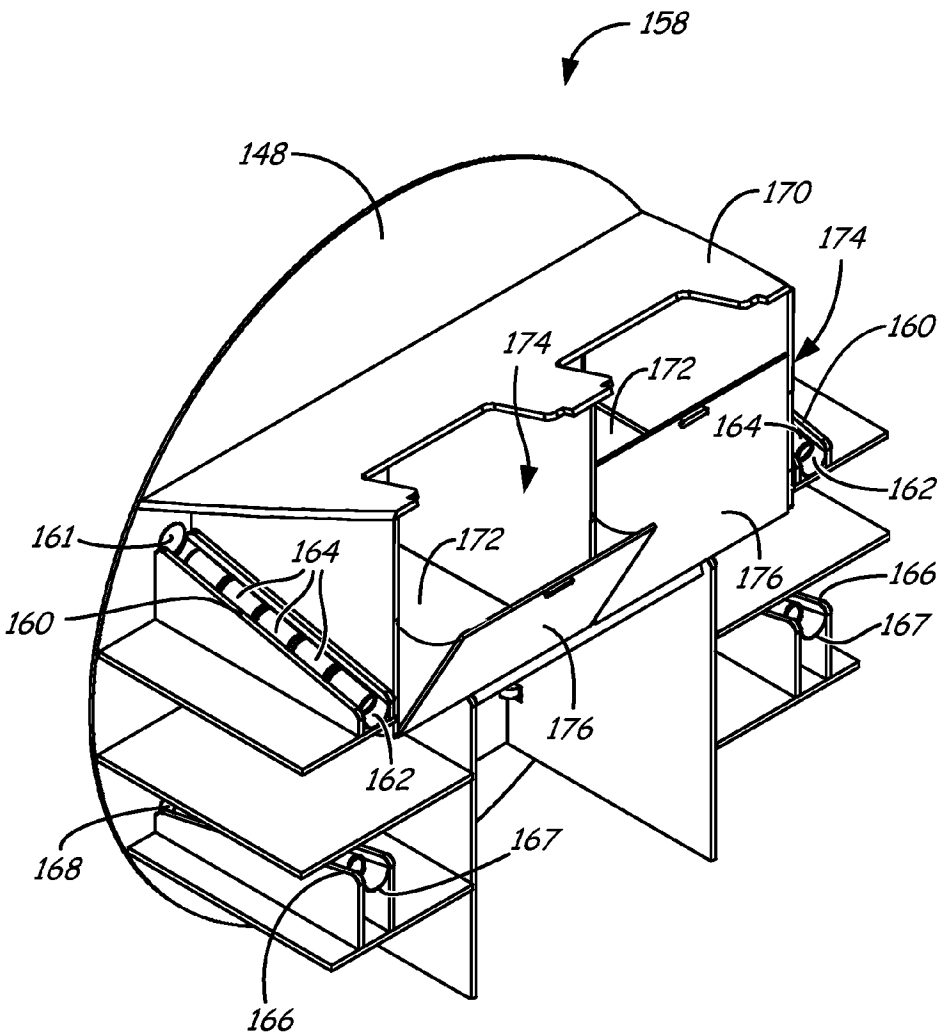
FIG. 9 illustrates a perspective view of a product retrieval system according to one embodiment.
Figure 10:
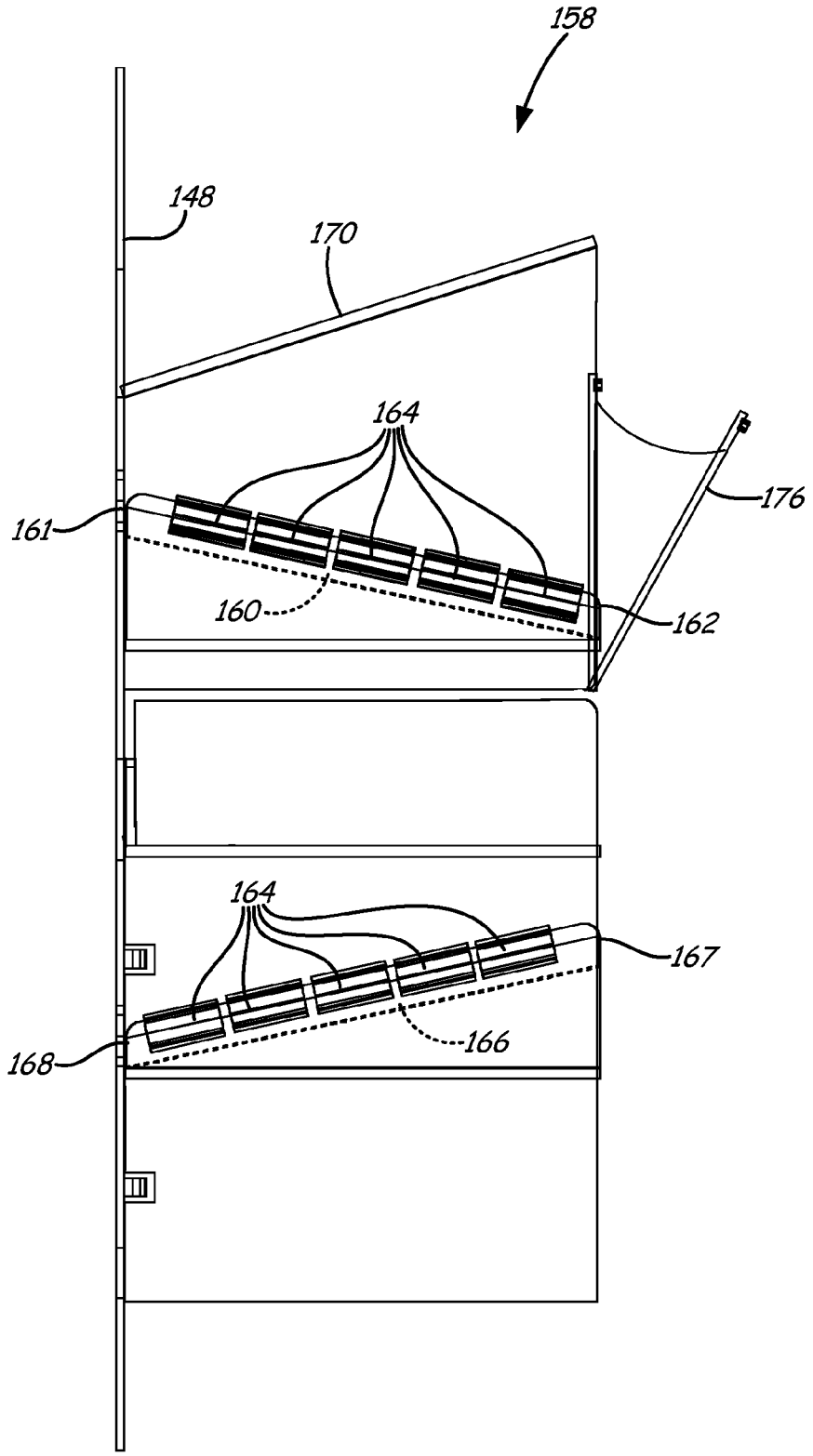
FIG. 10 is a side view of the product retrieval system illustrated in FIG. 9.
Figure 11:
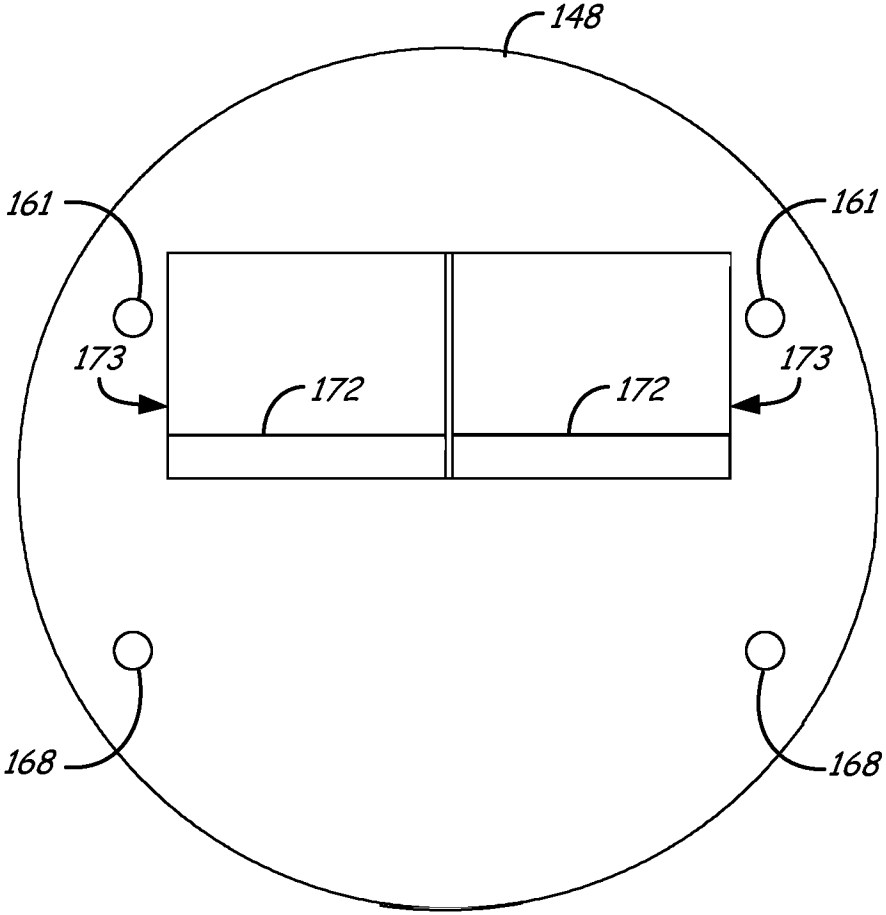
FIG. 11 is a front view of the product retrieval system illustrated in FIGS. 9-10.

FIG. 9 illustrates a back perspective view of product retrieval system 158 according to one embodiment. FIG. 10 is a side view of product retrieval system 158 illustrated in FIG. 9. FIG. 11 illustrates a front view of partition or divider wall 148 illustrating product retrieval system 158. In the embodiments illustrated in FIGS. 9-11, the at least one passageway includes at least one chute or channel 160 configured to transport or convey receptacles or capsules 164 that hold new product orders from register section or checkout area 144 to stock section or backroom area 146. At least one chute or channel 160 has an inlet 161 located at and accessible from the register section or checkout area side 144 of partition 148 and an outlet 162 located on and accessible from the stock section or backroom area side 146 of partition 148. In particular, inlet 161 is located above outlet 162 such that receptacles or capsules 164 filled with orders are gravity fed from register section 144 to stock section 146. As shown in the embodiment illustrated in FIGS. 9-11, product retrieval system 158 includes two chutes or channels 160 having inlets 161 and outlets 162. Each of chute or channel 160 corresponds with a respective register 152.

The at least one passageway of the product retrieval system 158 illustrated in FIGS. 9-11 also includes at least one chute or channel 166 configured to transport or convey empty receptacles or capsules 164 from stock section or backroom area 146 to register or distribution section 144. At least one chute or channel 166 has an inlet 167 located on and accessible from the stock section or backroom area side of partition 148 and an outlet 168 located on and accessible from the register section or checkout area side of partition 148. In particular, inlet 167 is located above outlet 168 such that empty receptacles or capsules 164 are gravity fed from stock section 146 to register or distribution section 144. As shown in the embodiment illustrated in FIGS. 9-11, product retrieval system 158 includes two chutes or channels 166 having inlets 167 and outlets 168. Each of chute or channel 166 corresponds with each of chute or channel 160.

The at least one passageway of the product retrieval system 158 illustrated in FIGS. 9-11 also includes a cabinet 170 accessible from register or distribution section 144 and also accessible from stock section or backroom area 146. Cabinet 170 includes at least one support shelf 172, which is configured to hold product retrieved from stock section or backroom area 146 so it can be passed to register or distribution section 144. As illustrated in FIGS. 9 and 11, support shelf 172 is illustrated as being flat. However, it should be realized that in other embodiment, support shelf could be angled from backroom area 146 to register or distribution section 144 like chutes 166. Cabinet 170 also includes at least one open end 173 and at least one closeable end 174. Open end 173 is on the register section or checkout area side of cabinet 170 and allows access to the at least one shelf 172 for retrieving product off shelf 172. Closeable end 174 includes a door 176 that allows access to at least one shelf 172 for placing product on shelf 172. As shown in the embodiment illustrated in FIGS. 9-11, cabinet 170 includes two support shelves 172 having open ends 173 and closeable ends 174. Each shelf 172 corresponds with each register 152.

While FIGS. 9-11 illustrate one type of product retrieval system where orders are manually conveyed to a backroom area for fulfillment and product is manually conveyed back to a checkout area to be given to a customer or guest, other types of product retrieval systems are considered. For example, in another embodiment, rather than manually passing orders from the checkout area to the backroom area through gravity fed receptacles or capsules, orders could be manually passed from the checkout area to the backroom area in other ways including order holders, order wheels, sliding order rack and spindle type order holders. In addition, orders could be electronically passed from the checkout area to the backroom area and viewed on a display screen located in the backroom area to then be fulfilled.

Figure 12:
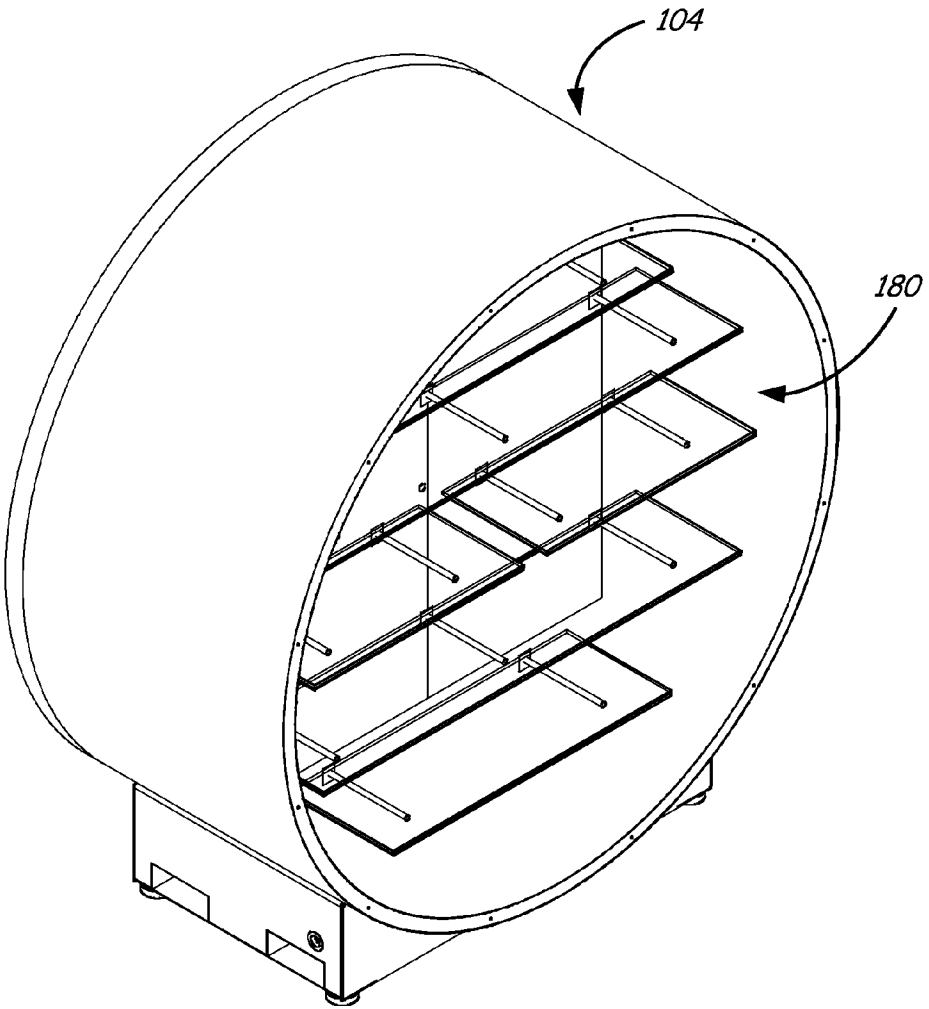
FIG. 12 is a back perspective view of a product display portion of the retail kiosk illustrated in FIGS. 1-5.

FIG. 12 is a back perspective view of product display portion 104. Product display portion 104 has an interior space that includes product display equipment. In one embodiment and as illustrated in FIG. 12, product display portion 104 includes a plurality of product display shelves 180. Product display shelves 180 are configured to display product for purchase.

In the shipping configuration illustrated in FIG. 1, the outer diameters 105 and 111 of product fulfillment portion 102 and product display portion 104 or continuous, circular edges 110 and 116 are in alignment. To transform retail kiosk 100 from the shipping configuration illustrated in FIG. 1 to the deployed configuration illustrated in FIG. 2, the outer diameter 111 or continuous, circular edge 116 of product display portion 104 is oriented out of alignment from the outer diameter 105 or continuous, circular edge 110 of product fulfillment portion 104 to deploy retail kiosk 100. In the alternative, to transform retail kiosk 100 from the shipping configuration illustrated in FIG. 1 to the deployed configuration illustrated in FIG. 2, the outer diameter 105 or continuous, circular edge 110 of product fulfillment portion 102 is oriented out of alignment from the outer diameter 111 or continuous, circular edge 116 of product display portion 104 to deploy retail kiosk 100.

In one embodiment, orienting the two portions 102 and 104 out of alignment from each other includes lifting portion 102 from a flatbed of a trailer, such as trailer 101, and positioning base 124 on a ground site and then lifting portion 104 from the flatbed of trailer 101 and positioning base 126 on the ground site so that the cylindrical shell of portion 104 is out of alignment with the cylindrical shell of portion 102. In the alternative portion 104 can be lifted from the flatbed of trailer 101 and positioned on the ground site and then portion 102 can be lifted from the flatbed of trailer 101 and positioned on the ground site such that the cylindrical shell of portion 102 is out of alignment with the cylindrical shell of portion 104. In other words, length 120 of portion 102 and length 118 of portion 104 are positioned at angle 122 from each other.

In another embodiment and when the two portions include integral wheels and are coupled to each other during shipping, orienting the two portions 102 and 104 out of alignment from each can be accomplished by rotating portion 104 from portion 102 using the integrally formed wheels.

When retail kiosk 100 is located in its deployed configuration, a customer can view the products on display in the product display portion 104 of retail kiosk 100. Using an order slip, the customer can write down the product or products that they would like to purchase and bring the order slip to the counter 150 located in register or distribution section 144 of product fulfillment portion 102 to be handed to an employee of the retail kiosk for further processing.

The employee retrieves an empty receptacle or capsule 164 from one of the outlets 168 of chute or channel 166 and places the order slip inside. The employee places the receptacle or capsule 164 housing the order slip into one of the inlets 161 of chute or channel 160. Via receptacle or capsule 164, the order slip is gravity fed to an employee who is working in the stock section or backroom area 146 of product fulfillment portion 102. In the backroom area, the employee retrieves the order slip in the receptacle or capsule 164 from outlet 162 and places the now empty receptacle or capsule 164 into one of the inlets 167 of chute or channel 166.

The employee in the backroom area selects product from product shelving 156 located in the backroom area that matches the item or items listed on the order slip and places the item or items selected on one of the shelves 172 located in cabinet 170 of product retrieval system 158 by opening door 176, setting the item or items on shelf 172 with the order slip and closing door 176. The employee located in the register section or checkout area completes the transaction by retrieving the item or items located on shelf 172 and ringing up the items on one of the registers 152.

As described above, the system of ordering products and retrieving products from retail kiosk 100 can be accomplished and/or performed in multiple different ways, including by other manual means or by electronic means.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A retail kiosk comprising:

a product fulfillment portion including a cylindrical shell having an end with a continuous, circular edge and a first longitudinal axis, substantially parallel to a ground surface, the product fulfillment portion including a personnel area sized to accommodate personnel and including a floor, and the product fulfillment portion including equipment for processing and fulfilling transactions; and a product display portion including a cylindrical shell having an end with a continuous, circular edge and a second longitudinal axis substantially parallel to the ground surface, the product display portion including equipment for displaying product, wherein the continuous, circular edge of the product fulfillment portion aligns with the continuous, circular edge of the product display portion such that the first and second longitudinal axes are aligned when the retail kiosk is configured for shipping, and wherein the continuous, circular edge of the product fulfillment portion is oriented out of alignment with the continuous, circular edge of the product display portion circumferentially and perpendicularly across the first and second longitudinal axes when the retail kiosk is deployed.

2. The retail kiosk of claim 1, wherein the end of the product fulfillment portion further comprises an open end defined by the continuous, circular edge, an opposite end of the product fulfillment portion being a closed end.

3. The retail kiosk of claim 1, wherein the end of the product display portion comprises an open end defined by the continuous, circular edge, an opposite end of the product display portion being a closed end.

4. The retail kiosk of claim 1, wherein the product display portion further comprises an interior space having a plurality of display shelves.

5. A retail pod comprising:

a first tube structure including an interior space with a first longitudinal axis substantially parallel to a ground surface, and comprising:

a distribution section;

a stock section, the distribution section extending a portion of a length of the first tube structure and the stock section separated from the distribution section by a partition and extending a remaining portion of the length of the first tube structure; and at least one passageway located through the partition that provides for two-way order processing comprising an order passed in a direction essentially parallel with the longitudinal axis by gravity from the distribution section through the partition to the stock section, and comprising a product requested by the order passed in the direction essentially parallel with the longitudinal axis from the stock section through the partition to the distribution section of the first tube structure; and a second tube structure including a second longitudinal axis substantially parallel to the ground surface, an outer diameter that is substantially similar to an outer diameter of the first tube structure, the second tube structure including a length that is less than the length of the first tube structure and including an interior space having components for displaying product, wherein the outer diameter of the second tube structure is circumferentially out of alignment with the outer diameter of the first tube structure perpendicularly across respective longitudinal axes of the first and second tube structures when the retail pod is deployed.

6. The retail pod of claim 5, wherein the retail pod further comprises at least one channel for conveying capsules containing orders from the distribution section to the stock section and at least one channel for conveying empty capsules from the stock section back to the distribution section.

7. The retail pod of claim 6, wherein the at least one channel that conveys capsules containing orders from the distribution section to the stock section comprises an inlet accessible from the distribution section and an outlet accessible from the stock section, wherein the inlet is located above the outlet.

8. The retail pod of claim 6, wherein the at least one channel that conveys empty capsules from the stock section back to the distribution section comprises an inlet accessible from the stock section and an outlet accessible from the distribution section, wherein the inlet is located above the outlet.

9. The retail pod of claim 5, wherein the at least one passageway further comprises an open end accessible from the distribution section and an opposing end having at least one door accessible from the stock section.

* * * * *